US011700974B2

(12) United States Patent
Ferris et al.

(10) Patent No.: US 11,700,974 B2
(45) Date of Patent: Jul. 18, 2023

(54) BATHING WALL SYSTEM

(71) Applicant: Delta Faucet Company, Indianapolis, IN (US)

(72) Inventors: Jeffrey David Ferris, Carmel, IN (US); David Michael Ringholz, Noblesville, IN (US)

(73) Assignee: Delta Faucet Company, Indianapolis, IN (US)

( * ) Notice: Subject to any disclaimer, the term of this patent is extended or adjusted under 35 U.S.C. 154(b) by 70 days.

(21) Appl. No.: 17/377,948

(22) Filed: Jul. 16, 2021

(65) Prior Publication Data

US 2022/0031125 A1 Feb. 3, 2022

Related U.S. Application Data

(60) Provisional application No. 63/057,886, filed on Jul. 28, 2020.

(51) Int. Cl.
*A47K 3/08* (2006.01)
*A47K 3/00* (2006.01)

(52) U.S. Cl.
CPC ..... *A47K 3/08* (2013.01); *A47K 3/008* (2013.01)

(58) Field of Classification Search
CPC ..... A47K 3/08; A47K 3/008; A47K 3/284; A47K 3/283; E04F 19/022; E04F 19/064; E04F 19/06; E04H 4/0043; E04H 4/31
See application file for complete search history.

(56) References Cited

U.S. PATENT DOCUMENTS 3,757,358 A 9/1973 Chisholm et al.
3,789,568 A * 2/1974 Mattix ..... E04F 19/022 52/747.1
3,827,086 A 8/1974 Seymour et al.
3,870,388 A 3/1975 Lofgren
4,384,377 A * 5/1983 Calvert ..... A47K 3/08 4/612
4,671,026 A 6/1987 Wissinger
5,303,519 A * 4/1994 Mustee ..... A47K 3/283 52/592.1
5,671,489 A 9/1997 Salach
7,028,349 B2 4/2006 Helmetsie et al.
8,082,608 B2 * 12/2011 Dabrowski ..... A47K 3/04 4/584
8,850,632 B2 * 10/2014 Bullis ..... A47K 3/02 4/584
9,027,176 B2 5/2015 Dabrowski
9,756,986 B2 9/2017 Zimbric
9,833,111 B2 12/2017 Torres

FOREIGN PATENT DOCUMENTS

CA 2732223 8/2012
EP 2491837 8/2012

OTHER PUBLICATIONS

Bestbath, SpringClip & SnapJoint, retrieved on Jun. 16, 2020 from https://bestbath.com/springclip-snapjoint/.

* cited by examiner

*Primary Examiner* — Janie M Loeppke
(74) *Attorney, Agent, or Firm* — Bose McKinney & Evans LLP

(57) ABSTRACT

A bathing wall system including a back wall, an end wall, and a coupler connecting the back wall and the end wall. The coupler includes a U-shaped receiving slot supported by the back wall, and a male connector supported by the end wall and received within the U-shaped receiving slot.

27 Claims, 11 Drawing Sheets

BATHING WALL SYSTEM

CROSS-REFERENCE TO RELATED APPLICATION

The present application claims priority to U.S. Provisional Patent Application Ser. No. 63/057,886, filed Jul. 28, 2020, the disclosure of which is expressly incorporated herein by reference.

BACKGROUND AND SUMMARY OF THE DISCLOSURE

The present disclosure relates generally to a bathing wall system, more particularly, to a bathing wall interfacing system that does not require caulk or sealant.

Currently, thermoformed bathing wall systems typically require caulk or sealant between adjacent walls to create watertight seams for daily use. Caulks and sealants, especially when used in showers may darken, become frayed on edges and/or collect bacteria. These current systems require maintenance and are rarely long term measures to acquire a watertight seal. Additionally, caulks and sealants, as they age and decay, often cannot sustain high water pressures that can be used to efficiently clean shower walls.

There remains a need for a bathing wall system that is easy to install and includes walls that interface without the need of gaskets, fasteners, weather-stripping, or sealant.

An illustrative bathing wall system is disclosed including a back wall and opposing end walls. The back wall includes opposing sides with U-shaped receiving slots with extended protrusions. The end wall includes a male grooved connector. The connector tightly seats between the sides of the U-channel on the back wall, and the groove snaps onto the extended back wall protrusions. The snap-fit mechanism provides obvious feedback that the back wall and end wall are fully seated. When connected, the resulting coupler or joint provides a duct for water that may enter the outer seam to flow downward to be expelled out of the bottom of the wall into the bathtub or shower base. Additionally, the bottoms of the back wall and the end walls include standoffs or splines to facilitate drainage from under the respective wall.

According to an illustrative embodiment of the present disclosure, a bathing wall system includes a tub, a back wall having a first terminal side, an opposing second terminal side wherein each of the first terminal side and the second terminal side has a U-shaped channel. An end wall includes an inner side having a snap groove connector, wherein the end wall is coupled to the back wall via a snap fit configuration between the snap groove connector and the U-shaped channel to create a water tight seal.

According to a further illustrative embodiment of the present disclosure, a bathing wall system includes a tub, a back wall supported above the tub and having a first terminal side, an opposing second terminal side, and a first snap-mount portion on each of the first terminal side and the second terminal side. An end wall is supported above the tub and includes an inner side and a second snap-mount portion on the inner side. The end wall is coupled to the back wall via a snap fit configuration between the second snap-mount portion of the end wall and the first snap-mount portion of the back wall. A corner joint includes a water flow duct defined by the first snap-mount portion of the back wall and the second snap-mount portion of the end wall.

According to another illustrative embodiment of the present disclosure, a bathing wall system includes a back wall extending between opposing first and second side edges, an end wall including a rear edge, and a coupler between the first side edge of the back wall and the rear edge of the end wall. The coupler includes a first coupler portion supported by the back wall, and a second coupler portions supported by the end wall. The first coupler portion includes a flange and a U-shaped channel defined between the first side edge of the back wall and the flange, and a protrusion spaced forwardly of the U-shaped channel. The second coupler portion includes a snap groove receiving the protrusion of the first coupler portion, and a positive pressure feed in engagement with the flange of the first coupler portion to exert force on the snap groove against the protrusion.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description of exemplary embodiments when taken in conjunction with the accompanying drawings, wherein.

Figure 1:
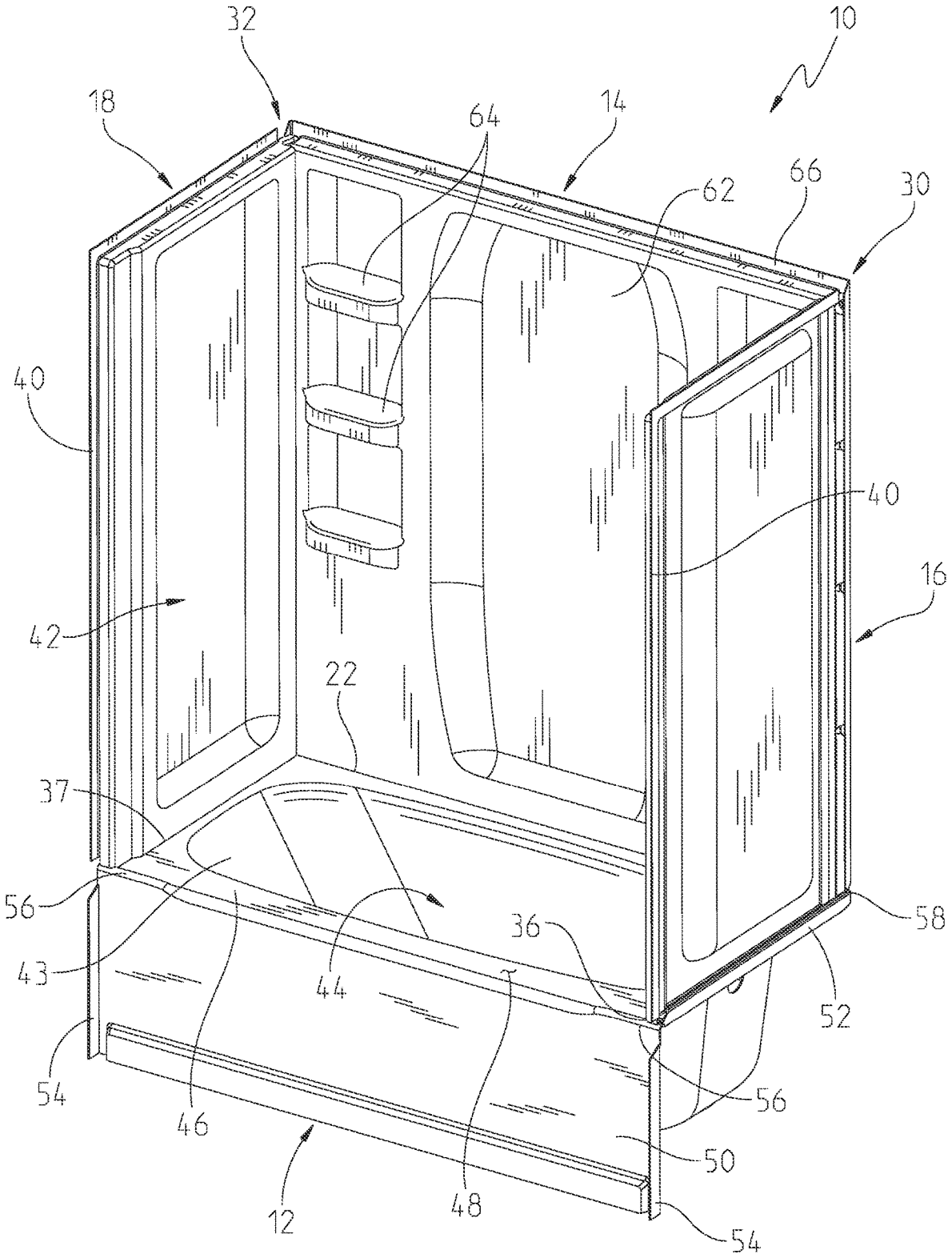
FIG. 1 is a perspective view of an illustrative bathing wall system in accordance with the present disclosure.

Corresponding reference characters indicate corresponding parts throughout the several views. Although the drawings represent exemplary embodiments of various features and components according to the present disclosure, the drawings are not necessarily to scale and certain features may be exaggerated in order to better illustrate exemplary embodiments of the invention, and such exemplifications are not to be construed as limiting the scope of the invention in any manner.

DETAILED DESCRIPTION OF THE DRAWINGS

For the purposes of promoting an understanding of the principles of the present disclosure, reference is now made to the exemplary embodiments illustrated in the drawings, which are described below. The exemplary embodiments disclosed below are not intended to be exhaustive or limit the present disclosure to the precise form disclosed in the following detailed description. Rather, the exemplary embodiments are chosen and described so that others skilled in the art may utilize their teachings. Therefore, no limitation of the scope of the present disclosure is thereby intended.

Referring initially to FIGS. 1-3 and 5, a bathing wall system or enclosure 10 is shown for use in connection with a tub 12. The bathing wall system 10 includes a back wall 14 and opposing right and left end walls 16 and 18. A bottom 20 of back wall 14 is supported above the tub 12 defining a lower drainage opening or gap 22. Opposing right and left sides 24 and 26 of back wall 14 are connected to the right and left end walls 16 and 18 at right and left corner joints or couplers 30 and 32, respectively. End walls 16 and 18 are also supported above the tub 12 to define right and left lower drainage openings or gaps 36 and 37. Each end wall 16 and 18 includes a rear or inner side 38 coupled to back wall 14 at corner joints or couplers 30 and 32, and a front or outer side 40 facing an open end of tub 12. Back wall 14 and end walls 16 form an open enclosure 42, within which a user can shower or bathe.

Tub 12 is illustratively formed of a conventional material, such as a thermoformed acrylic or a porcelain enameled steel. The back wall 14 and the end walls 16 and 18 of the bathing wall system 10 are illustratively constructed of a conventional material, such as a polymer. In one illustrative embodiment, the back wall 14 and the end walls 16 and 18 are illustratively formed of a thermoformable material, such as a thermoformed acrylic and, as descried below, are configured to fit together in such a way that provides a watertight seal without the use of caulk, gaskets, weather stripping, or any other type of sealant known in the art.

Figure 2:
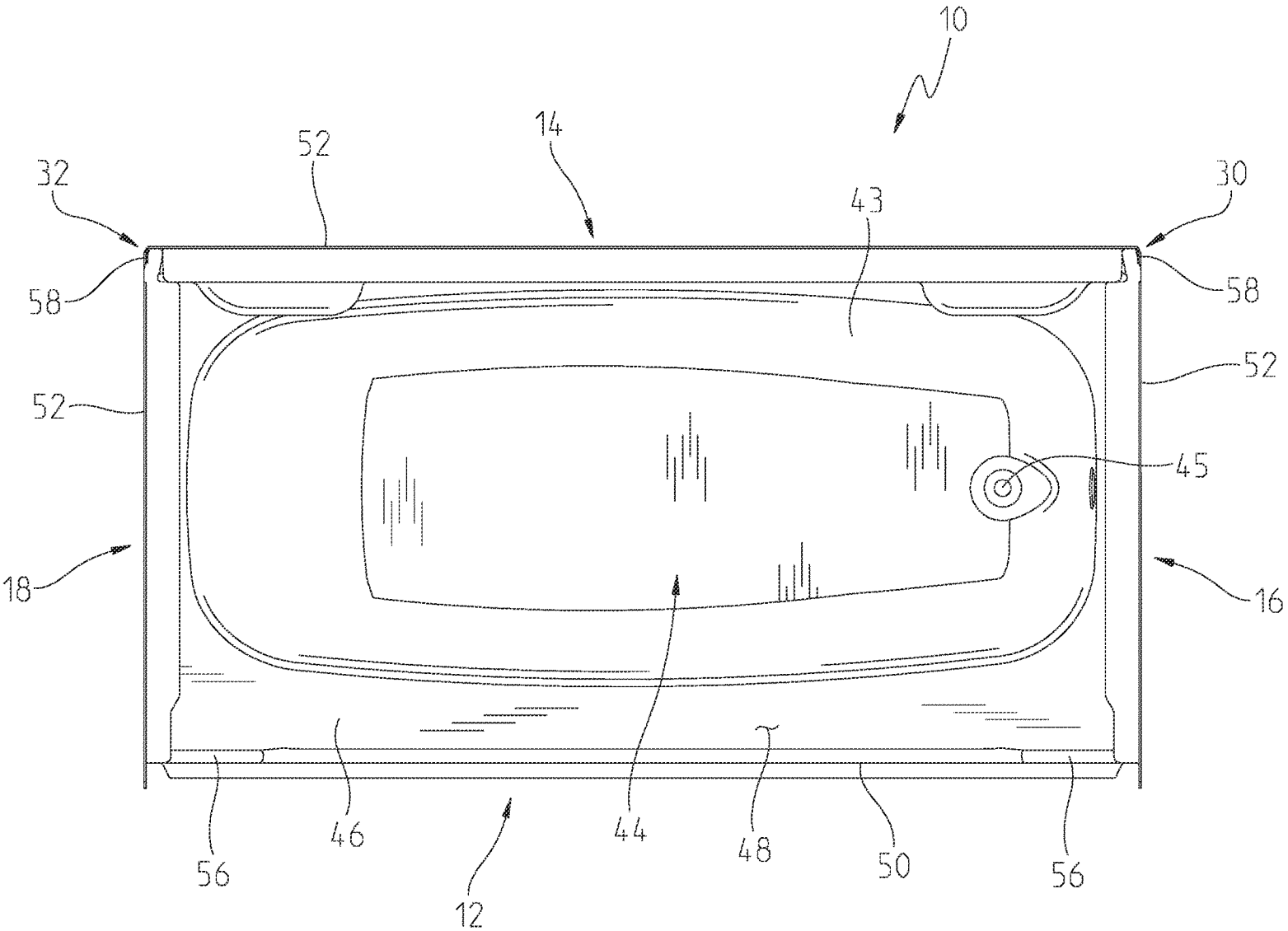
FIG. 2 is a top view of the bathing wall system of FIG. 1.

As shown in FIGS. 1 and 2, the illustrative tub 12 may be of conventional design as including a cavity or basin 44 defined by a side wall 43 and a drain 45. A ledge or shelf 46 includes an upper surface 48 sloping inwardly toward the basin 44. The tub 12 further illustratively includes a front wall 50 and a back splash 52. Front wall 50 extends vertically down from the top of tub 12 and extends the length of tub 12. Front wall 50 includes wall mounting flanges or lips 54 which border the outside edges of front wall 50. Front wall 50 illustratively includes upwardly extending lips or water dams 56 at opposing sides of the top terminal end of front wall 50. Dams 56 are raised, curved edges which are tapered down to the top surface 48 of shelf 46 of tub 12 toward a center of the tub 12. Other embodiments of dams 56 are envisioned to include a single, longer dam 56 which extends across the full length of tub 12. Conversely, dams 56 may only extend the width of end walls 16, 18. Wall mounting lips or flanges 54 extend forward of front wall 50 and opposite tub 12. Wall mounting flanges 54 are configured to be fastened to wall studs and be enclosed behind dry wall or any other type of structural finishing (not shown).

With further reference to FIGS. 1 and 2, back splash 52 extends vertically up from the outer edges of, and spans both sides and the back of tub 12. At the top terminal end of back splash 52 is a lip or deflector 58 which extends horizontally towards tub 12 from back splash 52 and terminates at least in close proximity to back wall 14 and end walls 16, 18. Back splash 52 is spaced apart from the basin 44 of tub 12 such that back wall 14, end walls 16, 18 and corner joints 30, 32 are mounted interior of back splash 52.

Figure 3:
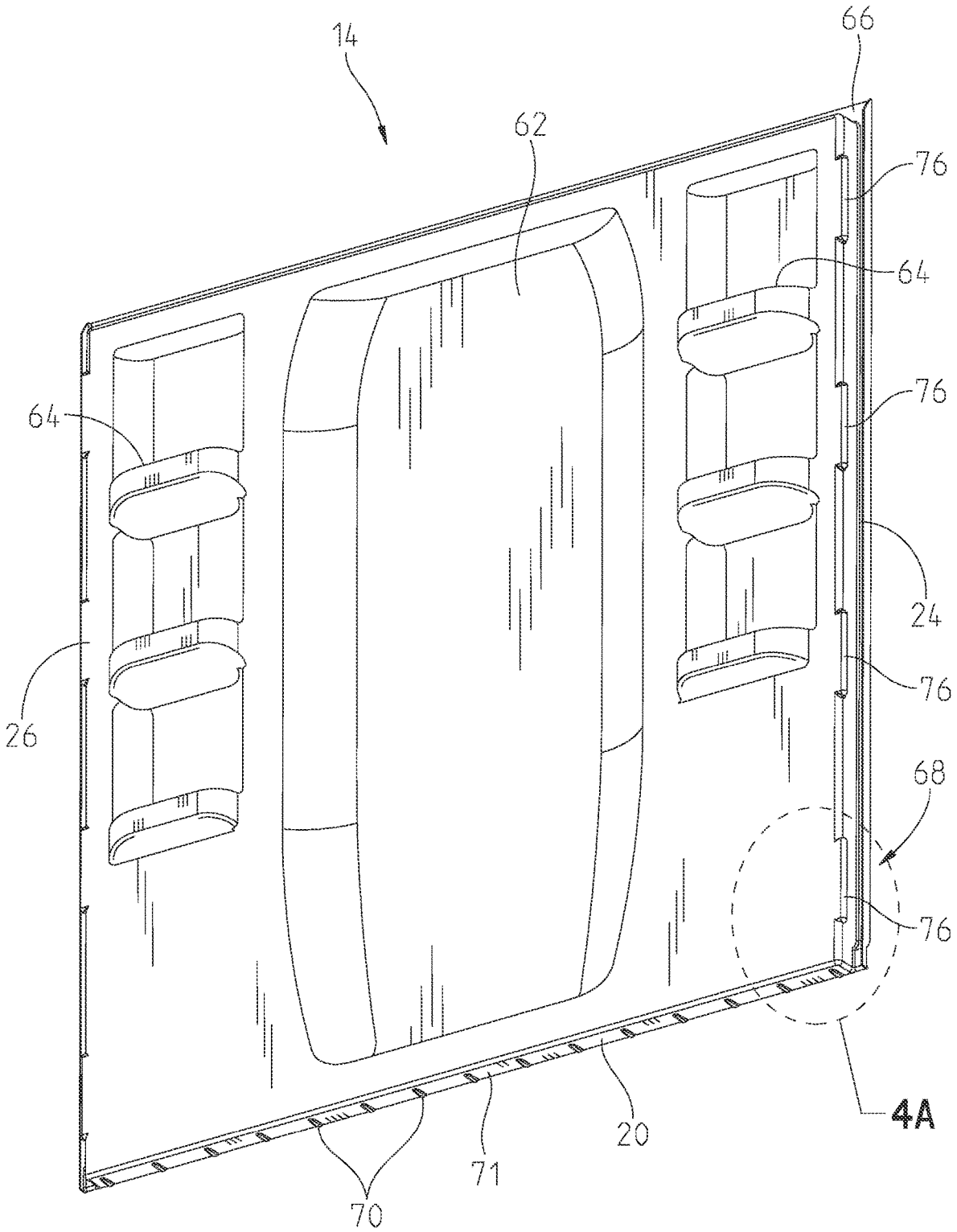
FIG. 3 is a perspective view of an illustrative back wall of the bathing wall system of FIG. 1.

As shown in FIG. 3, the back wall 14 of bathing wall system 10 may illustratively include molded aesthetic and ergonomic features such as a cavity 62 and shelves 64. In some illustrative embodiments, back wall 14 may have other molded features known in the art, or the features may be configured in other ways. Illustrative back wall 14 may also include a dry wall lip or mounting flange 66, a first coupling or snap-mount portion 68, and bottom standoffs or splines 70. Dry wall lip 66 extends horizontally across the top edge of back wall 14. Snap-mount portions 68 extend vertically down both sides of, and span the height of, the back wall 14. Bottom splines 70 are raised portions which extend in spaced apart relationship horizontally across the bottom edge of back wall 14. The bottom splines 70 and are configured to allow water to flow from underneath back wall 14, and into tub 12, as described in detail below.

Figure 4A:
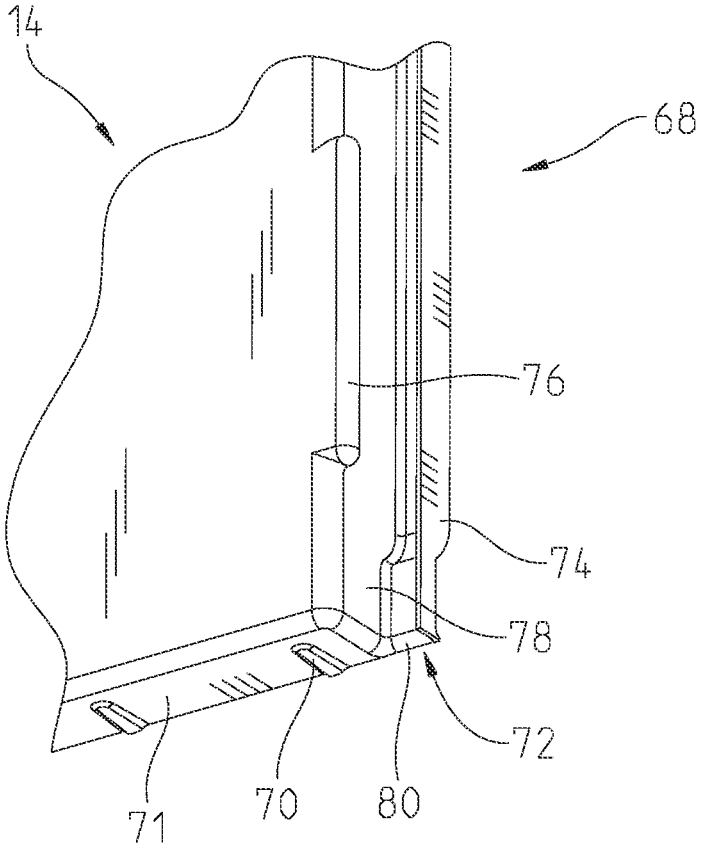
FIG. 4A is a detail view of the back wall of FIG. 3.
Figure 4B:
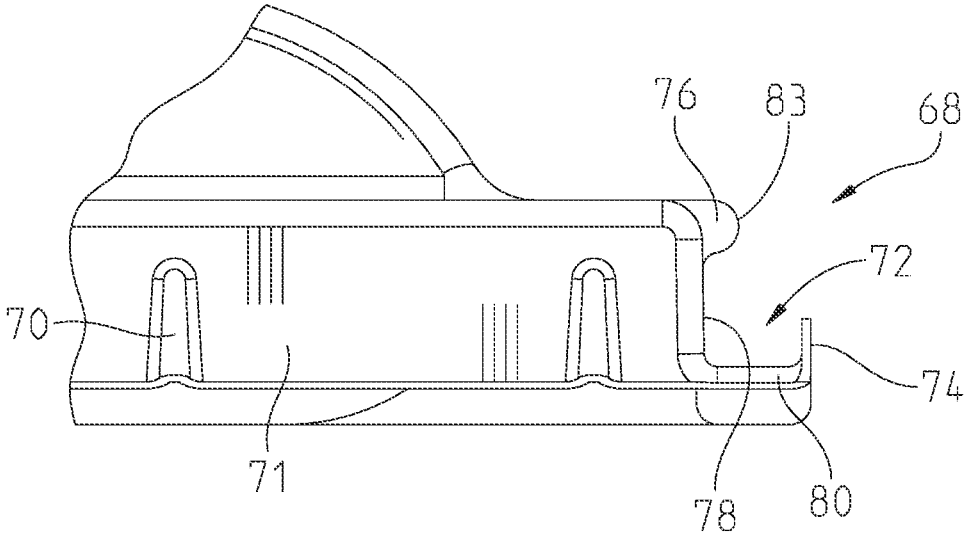
FIG. 4B is a partial bottom perspective view of the back wall of FIG. 4A.

As further detailed in FIGS. 3, 4A and 4B, each snap-mount portion 68 of back wall 14 includes a U-shaped channel 72, a snap flange 74, and protrusions 76. The U-shaped channel 72 is defined by a terminal side end or edge 78 of back wall 14, an outward extension 80 from the terminal side end 78, and snap flange 74. Snap flange 74 is a thin forward extension which spans a distance less than the depth of U-shaped channel 72. Protrusions 76 extend horizontally outward from a plane defined by back wall 14, to a length less than that of U-shaped channel 72. The protrusions 76 illustratively extend from a forwardmost end of the terminal side end 78 of the back wall 14. Illustrative protrusions 76 have a depth also less than that of U-shaped channel 72 and are defined by a rounded edge, illustratively a forward or convex curve 83. As shown best in FIG. 3, multiple protrusions 76 are illustratively spaced apart in a vertical direction along the side edge 78 of back wall 14. Snap-mount portion 68 disposed on the opposite side of back wall 14 illustratively includes the same shape and structure as depicted in FIGS. 4A and 4B.

Figure 5:
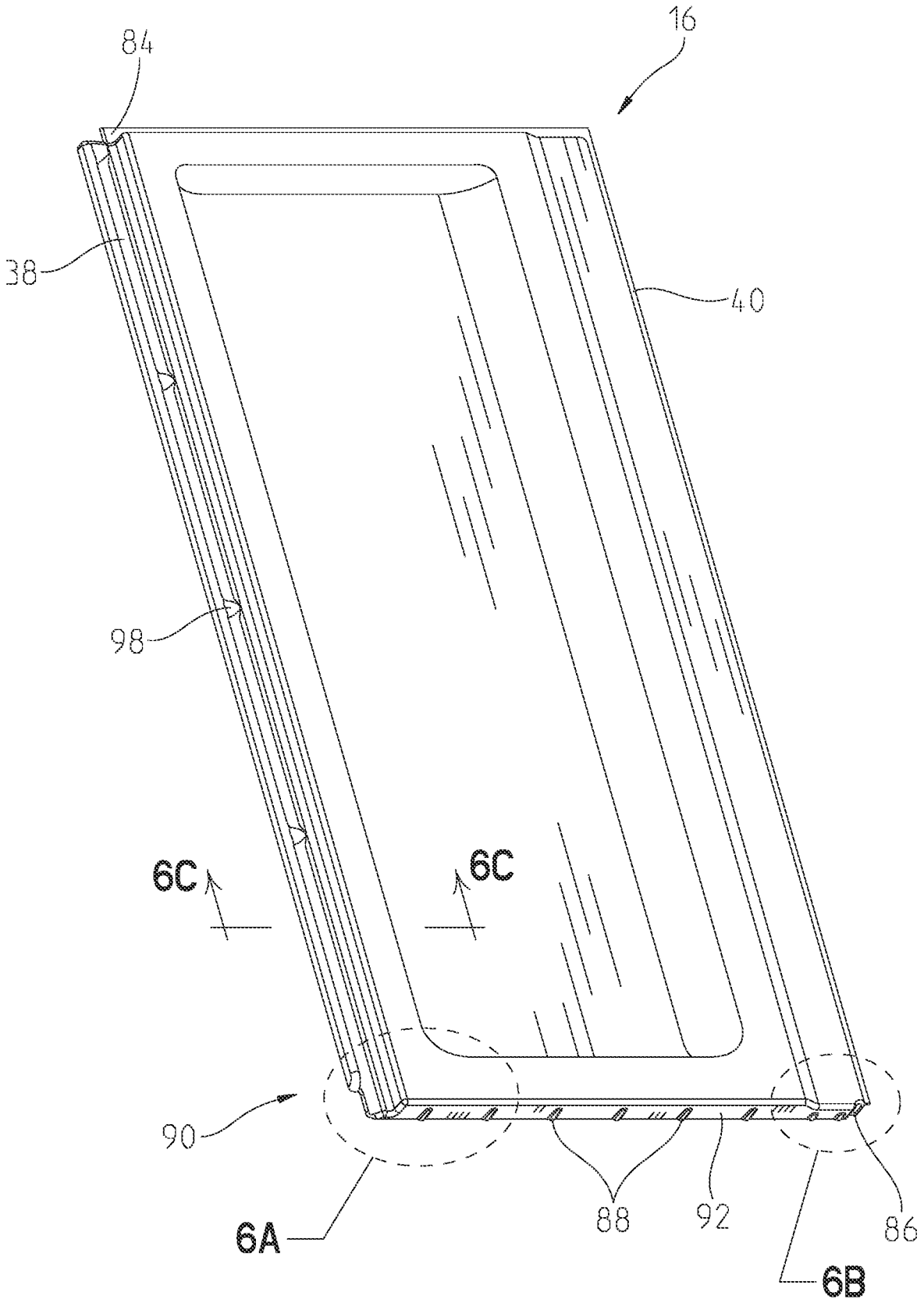
FIG. 5 is a perspective view of an illustrative end wall of the bathing wall system of FIG. 1.

As shown in FIG. 5, end walls 16 and 18 may also include aesthetic and ergonomic features similar to back wall 14. In some illustrative embodiments, end walls 16 and 18 may have different functional and/or aesthetic features from each other, and may include additional shelves, different sized cavities, etc. In other illustrative embodiments, end walls 16 and 18 may have identical functional and/or aesthetic features and be mirror images of each other. End walls 16 and 18 illustratively also include dry wall lips or mounting flanges 84, a water dam receiving recess 86, bottom standoffs or splines 88, and a second coupling or snap-mount portion 90 (e.g., snap groove connector).

Figure 6A:
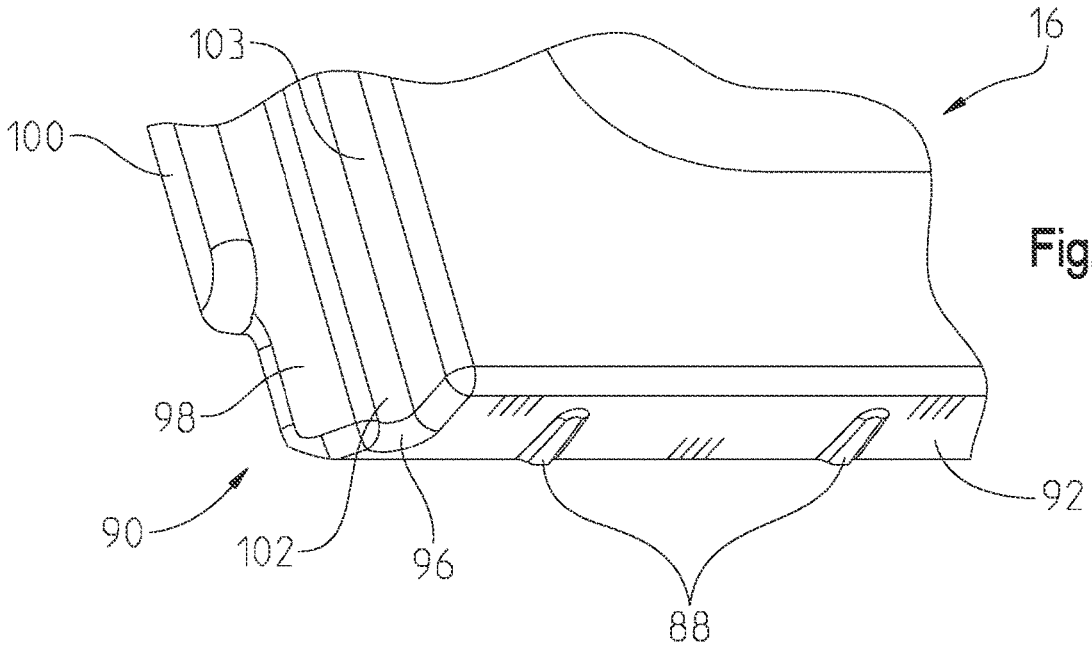
FIG. 6A is a first detail view of the end wall of FIG. 5.
Figure 6B:
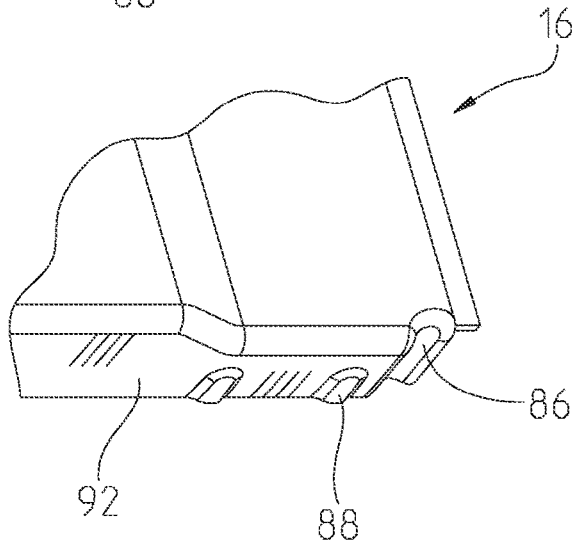
FIG. 6B is a second detail view of the end wall of FIG. 5.
Figure 6C:
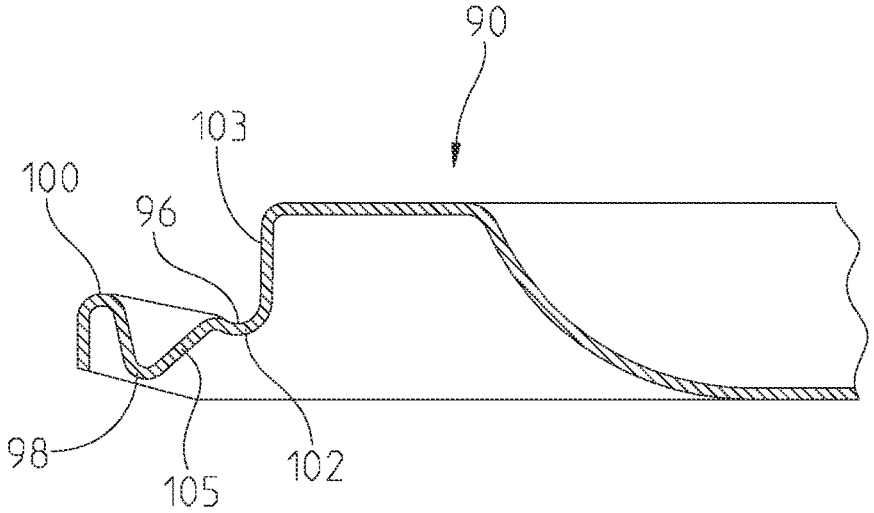
FIG. 6C is a partial, cross-sectional view of the end wall taken along line 6C-6C of FIG. 5.

With reference to FIGS. 5-6C, dry wall lip or mounting flange 84 extends horizontally across the top edge of end wall 16, 18, similar to the mounting flanges 54 of tub 12. Water dam recess 86 is illustratively disposed at the front, bottom corner of each end wall 16, 18. As detailed in FIG. 6B, water dam recess 86 is defined by a rounded, concave shape which matches the convex shape of, and is configured to receive respective lip or dam 56 of tub 12. Bottom splines 88 are raised portions which extend in spaced apart relationship horizontally across the bottom edge 92 of end wall 16, 18 and are configured to allow water to flow from underneath end wall 16, into tub 12, as described in detail below.

Figure 8A:
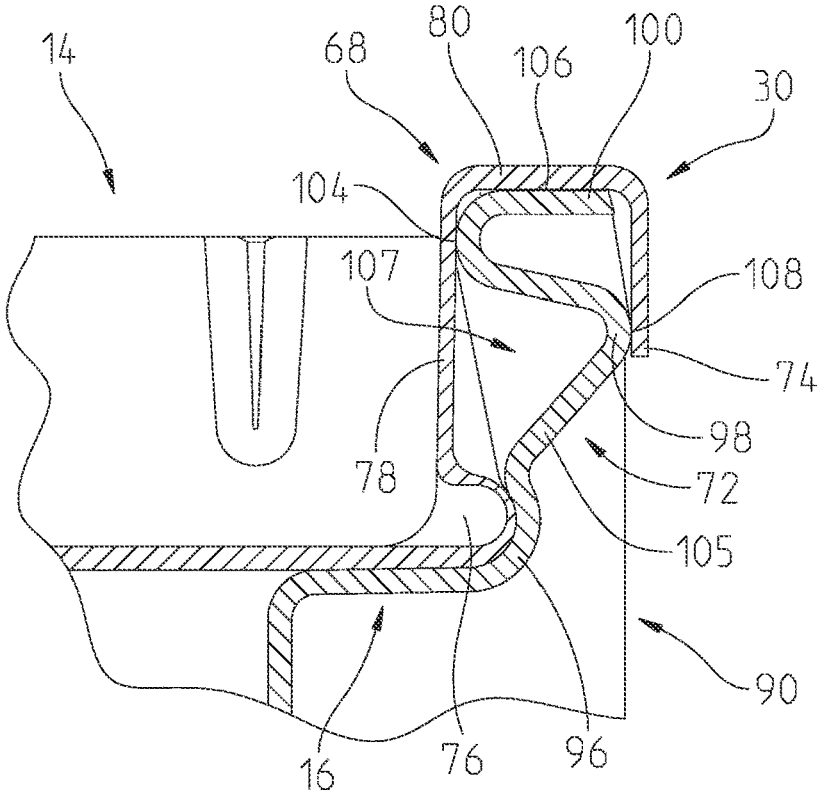
FIG. 8A is a partial, cross-sectional view of the coupler between the back wall and the right end wall of the bathing wall system taken along line 8A-8A of FIG. 7.

Referring again to FIGS. 5 and 6A, second coupling portion 90 is disposed along the rear side 94 of each end wall 16 and 18. As detailed in FIGS. 6A and 6C, second coupling portion 90 of each end wall 16 and 18 includes a snap groove 96, a positive pressure bead 98, and a groove connector 100. Snap groove 96 is defined by a rearward or concave curve 102 extending from a terminal side end or edge 103 and which partially matches the shape of protrusions 76 (e.g., convex curve 83) of back wall 14. Snap groove 96 extends vertically down the side of each end wall 16 and 18. Pressure beads 98 are raised pyramid shapes with rounded edges and, as best shown in FIG. 5, are spaced apart in a vertical direction along the length of snap-mount portion 90. As shown in FIGS. 6C and 8A, pressure beads 98 extend approximately the width of U-shaped channel 72 and are configured to engage snap flange 74 when back wall 14 and respective end wall 16, 18 are mounted together. A connecting web 105 illustratively extends between the pressure beads 98 and the snap groove 96 of the second snap mount portion 90. The connecting web 105 is spaced apart from the terminal end 78 of the back wall 14.

Figure 8B:
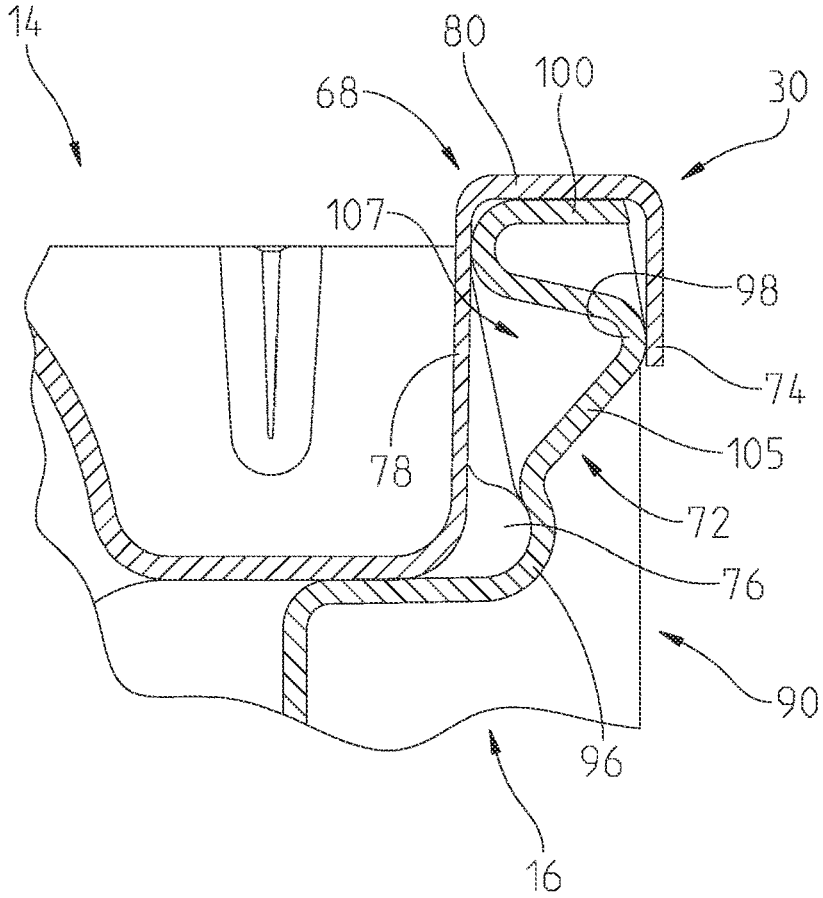
FIG. 8B is another partial, cross-sectional view of the coupler between the back wall and the right end wall of the bathing wall system taken along line 8B-8B of FIG. 7.
Figure 8C:
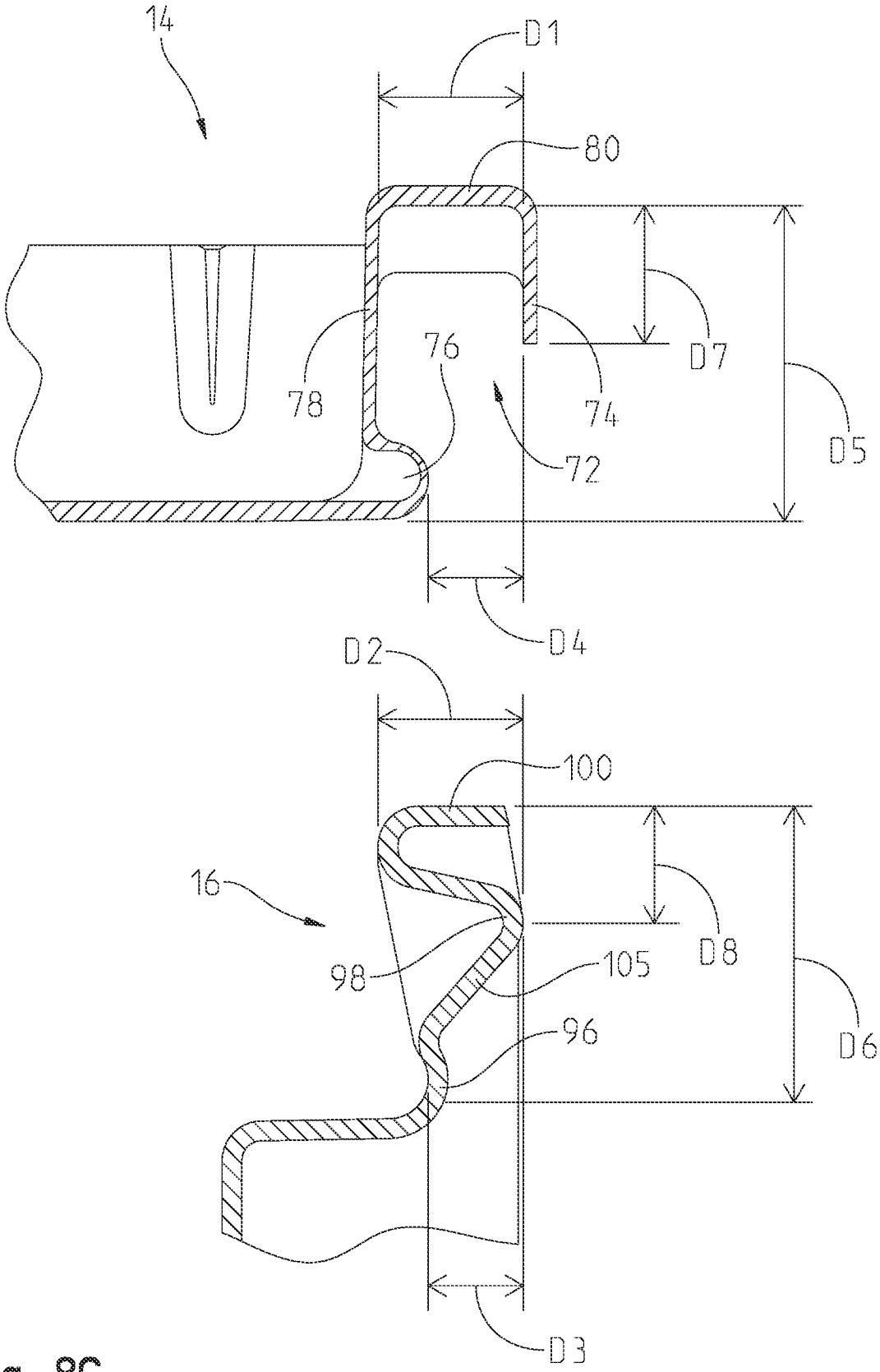
FIG. 8C is an exploded partial, cross-sectional view of the coupler similar to FIG. 8A.

With reference to FIGS. 6A and 6C, groove connector 100 is defined by a rearward curve in the material of snap-mount portion 90 which then extends outward in the same direction as pressure bead 98. With reference to FIGS. 8A-8C, groove connector 100 extends to a length less than that of the width of U-shaped channel 72 (D1) and the height of pressure bead 98 (D2). The distance between groove connector 100 and the snap groove 96 (D6) is substantially the same as the distance between the rearward most surface of U-shaped channel 72 and protrusion 76 (D5).

Figure 7:
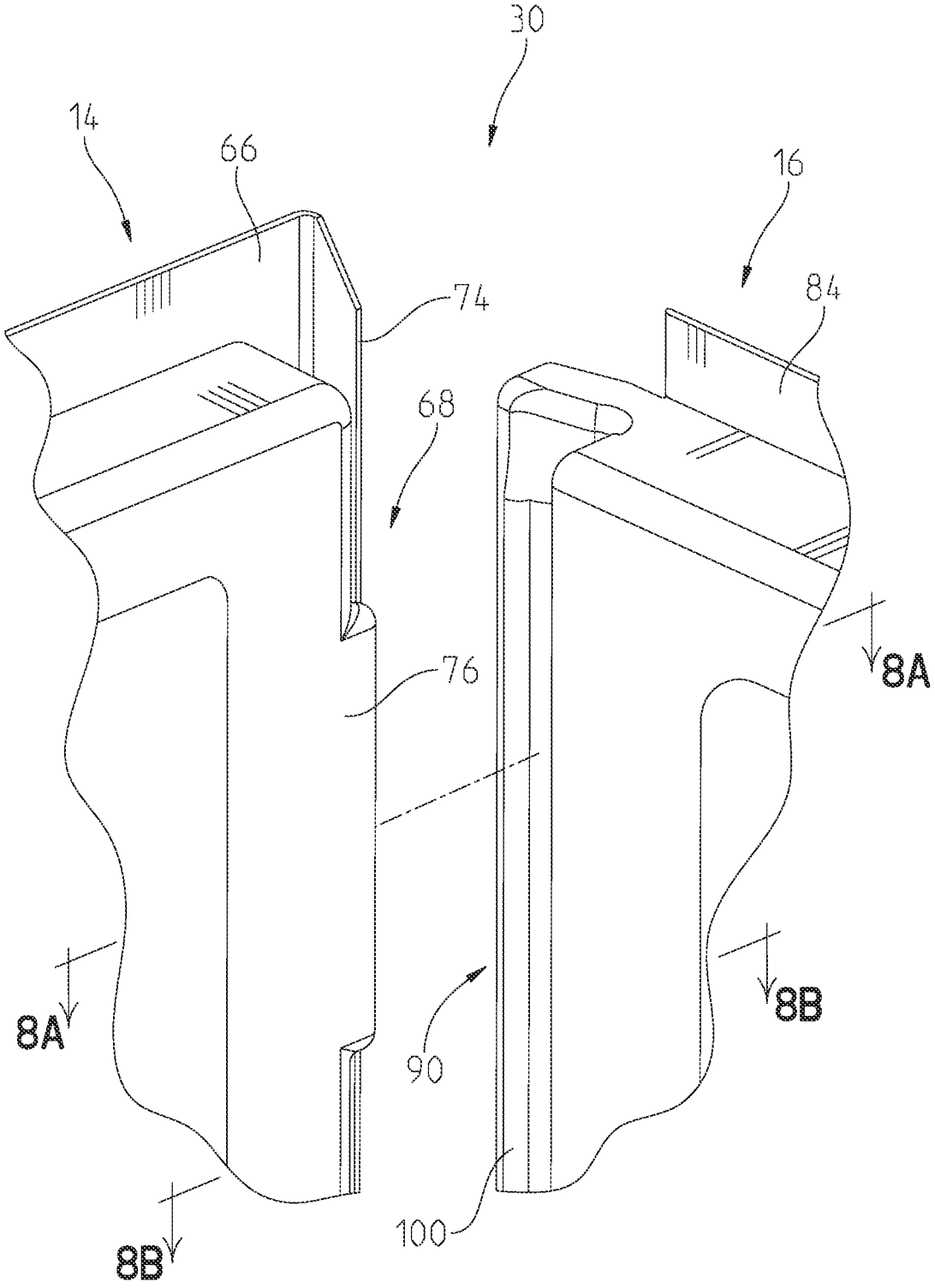
FIG. 7 is an exploded perspective view of an illustrative coupler between the back wall and end wall of the bathing wall system of FIG. 1.

FIG. 7 shows back wall 14 and end wall 16 in proximity and aligned for coupling to define the corner joint or coupler 30. During coupling, back wall 14 is aligned with end wall 16 such that U-shaped channel 72 and groove connector 100 are on the same level. Groove connector 100 tightly seats between the sides of U-shaped channel 72, and groove connector 100 snaps into U-shaped channel 72 behind protrusions 76. Snap flange 74 flexes outward during insertion of snap-mount portion 90 allowing snap groove 96 to accept protrusions 76. The snap-fit mechanism gives obvious feedback that the walls 14 and 16 are fully seated. Pressure bead 98 provides a bias between end walls 16, 18 and back wall 14 to promote sturdiness of corner joint 30 and 32. When connected, the resulting joint 30, 32 provides a duct 107 for water that may enter center side joints 30, 32 to flow downward to be expelled out of the bottom of back wall 14 or end walls 16 into tub 12. The illustrative duct 107 is defined by the space between the protrusions 76, the connecting web 105, and the terminal end 78 of the back wall 14. Additionally, the bottom of the wall panels 14, 16, 18 have splines 70 and 88 to facilitate drainage from under back wall 14 and end walls 16, 18 through a space or passageway 109, as described in more detail below.

FIGS. 8A and 8B show back wall 14 and end wall 16 coupled together at corner joint 30. Specifically, FIG. 8A shows a cross-section of corner joint 30 along the line shown in FIG. 7 labeled 8A and through one of protrusions 76 which are spaced about along the length of back wall 14. When snap-mount portion 68 and snap-mount portion 90 are coupled together, groove connector 100 is at least in close proximity to the rearwardmost surface, and inwardmost surface of U-shaped channel 72. Additionally, pressure bead 98 is engaged with snap flange 74. Finally, snap groove 96 accepts and extends around the crest of protrusion 76 while the terminal end of end wall 16 extends along and is at least in close proximity to a portion of the forward-facing surface of back wall 14. The space created by the hollow nature of pressure bead 98 and the space between protrusions 76, along with the curved nature of both structures creates duct 107 to allow water that may get within corner joint 30 to drain down to bottom splines 70 and 88. Because of the proximity within which the various structural components of back wall 14 and end walls 16 are situated, only pressurized water, used in cleaning bathing wall system 10 would penetrate corner joint 14 and would not reach beyond, but would be drained down to tub 12 through duct 107 and passageway 109.

An illustrative corner joint 30 is further detailed in FIGS. 8A-8C, wherein 104 is a first flow restriction, 106 is a second flow restriction, and 108 is an engagement point between the snap flange 90 and the positive pressure bead 98. In FIG. 8C, illustrative dimensions are approximately as follows: D1 is 0.917 inches, D2 is 0.918 inches, D3 is 0.60 inches, D4 is 0.601 inches, D5 is 2.00 inches, D6 is 1.980 inches, D7 is 0.875 inches, and D8 is 0.623 inches.

Figure 9:
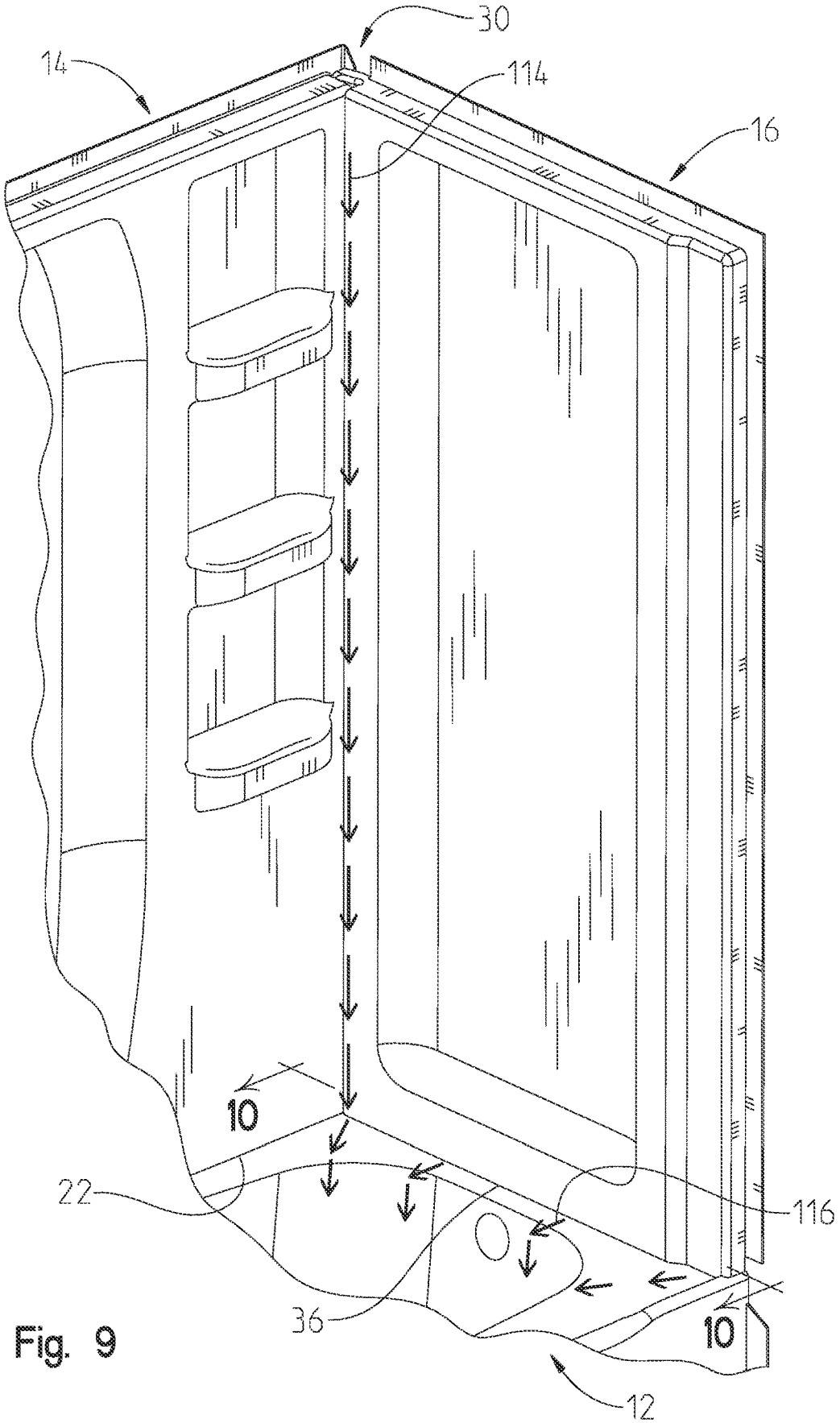
FIG. 9 is a partial perspective view of the bathing wall system of FIG. 1, showing illustrative water flow paths between the back wall and the right end wall.
Figure 10:
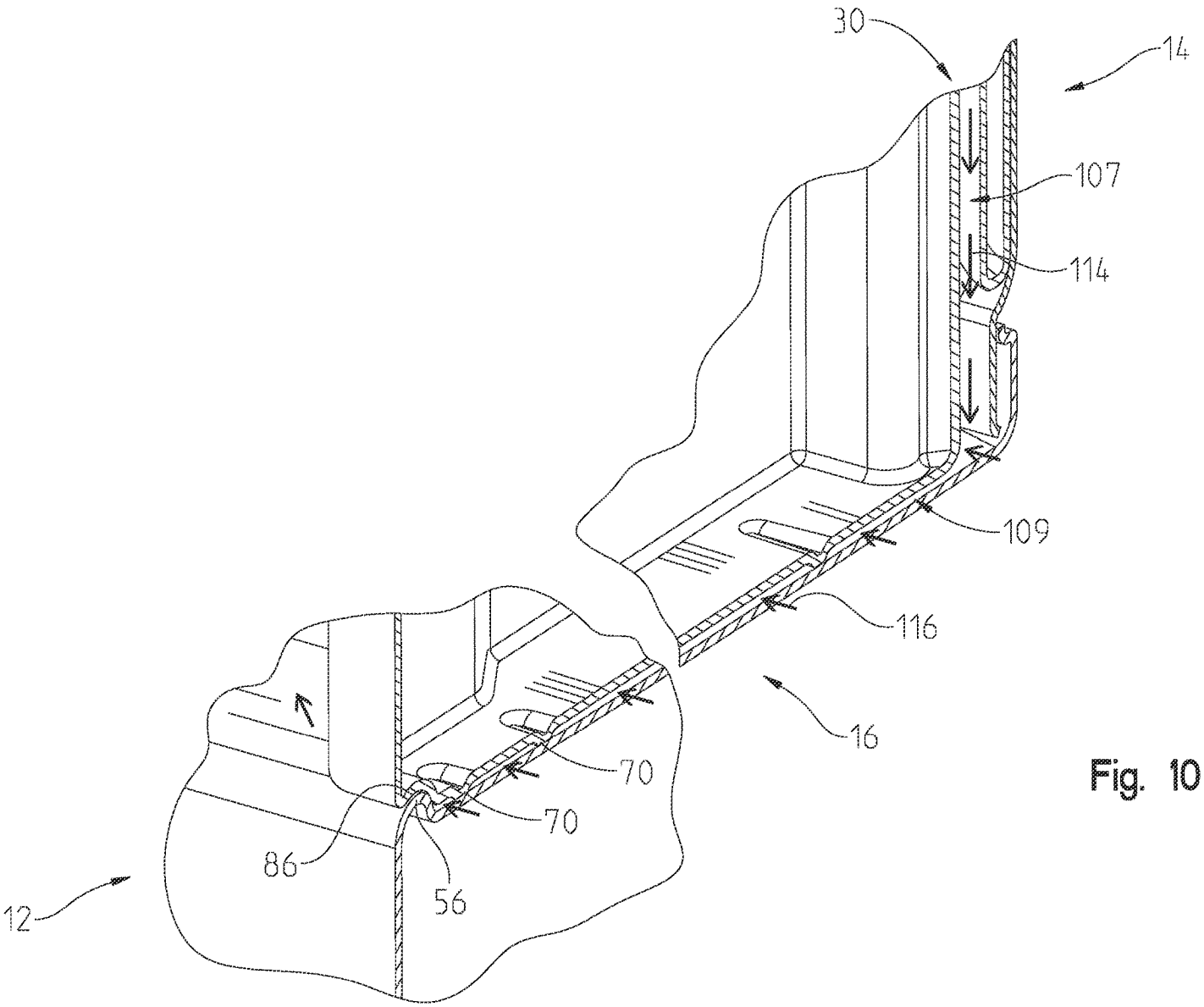
FIG. 10 is a partial perspective view of the bathing wall system in partial cross-section taken along line 10-10 of FIG. 9, showing illustrative water flow baths between the back wall and the right end wall.

FIG. 9 shows illustrative flow paths 114 and 116 through duct 107 and passageway 109, respectively. Flow path 114 shows the drainage of water which seeps into corner joint 30 and flows down along pressure bead 98 (via duct 107) and bottom splines 70, 88 (via passageway 109). Flow path 116 shows the drainage of water that seeps into bottom gap 22 which would be further prevented from flowing into the wall structure of the bathroom by back splash 52 and deflector 58 (FIG. 1). The raised nature of back splash 52 ensures that pressurized water which enters into bottom gap 22 is pushed up by back splash 52 and then forced back down by deflector 58. FIG. 10 shows bottom splines 88 of end wall 16 which provide vertical space between end wall 16 and tub 12 which allows water to flow from either back splash 52 or from corner joint 30 and into tub 12. Bottom splines 70 of back wall 14 operate to provide the same vertical space between back wall 14 and tub 12. Furthermore, recesses 86 of end walls 16, 18 are shown in FIG. 10 to be in contact with dams 56 of tub 12. This engagement discourages water from flowing from the vertical space between end walls 16, 18 and tub 12, out of tub 12 and onto the floor of a bathroom. In some embodiments, tub 12 can have a slight decline leading into the basin of tub 12, which provides further encouragement of water flow into tub 12.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A bathing wall system comprising:

a tub;

a back wall including a first terminal side, an opposing second terminal side, each of the first terminal side and the second terminal side having a U-shaped channel;

an end wall including an inner side having a terminal end with a snap groove connector;

wherein the end wall is coupled to the back wall via a snap fit configuration between the snap groove connector and a first one of the U-shaped channels to create a watertight seal;

wherein the first one of the U-shaped channels is defined by the terminal side of the back wall, a horizontal extension which extends from a rearwardmost end of the terminal side of the back wall, and a snap flange spaced apart from the terminal side of the back wall and extending forward from the horizontal extension; and wherein the snap groove connector includes a positive pressure bead, wherein the positive pressure bead is engaged with the snap flange thereby biasing a portion of the snap groove connector against the terminal side of the back wall to form a first flow restriction within the first one of the U-shaped channels.

2. The bathing wall system of claim 1, wherein the back wall further includes a protrusion which extends horizontally from the back wall opposite the first one of the U-shaped channels.

3. The bathing wall system of claim 2, wherein the back wall includes at least two protrusions spaced apart in a vertical direction.

4. The bathing wall system of claim 2, wherein the protrusion includes a convex curvature.

5. The bathing wall system of claim 4, wherein the snap groove connector further includes a snap groove extending from a mid-portion of the inner end of the end wall.

6. The bathing wall system of claim 5, wherein the snap groove has a concave curvature matching the convex curvature of the protrusion, such that the protrusion nests within the snap groove.

7. The bathing wall system of claim 1, wherein the back wall and the end wall are constructed of a thermoformed material.

8. The bathing wall system of claim 1, further comprising a vertically extending drainage duct within the first one of the U-shaped channels and defined by the terminal side of the back wall forward of the first flow restriction and a connecting web of the snap groove connector disposed between the positive pressure bead and the terminal end of the of the inner side of the end wall, the drainage duct configured to drain water to the tub.

9. The bathing wall system of claim 8, wherein the tub includes a basin and a shelf bordering and extending out from a top border of the basin, wherein the shelf is defined by an inward sloping surface.

10. The bathing wall system of claim 9, wherein the back wall and the end wall rest on the shelf.

11. A bathing wall system comprising:

a tub having a basin, a shelf bordering and extending out from a top border of the basin, and a back splash which extends vertically up from an outer perimeter of the shelf;

a back wall supported above the tub and including a first terminal side, an opposing second terminal side, and a first snap-mount portion on each of the first terminal side and the second terminal side;

an end wall supported above the tub, the end wall including an inner side and a second snap-mount portion on the inner side;

wherein the end wall is coupled to the back wall via a snap fit configuration between the second snap-mount portion of the end wall and the first snap-mount portion of the back wall; and wherein the back wall and the end wall further include a plurality of splines spaced apart along the length of a bottom surface of the back wall and along the length of a bottom surface of the end wall, the plurality of splines engaging the shelf of the tub to support the back wall and the end wall within the perimeter of the back splash and to create a first space between the bottom surface of the back wall and the shelf and a second space between the bottom surface of the end wall and the shelf and wherein the shelf is defined by an inward sloping surface whereby the first space and the second space drain into the basin.

12. The bathing wall system of claim 11, wall further comprising a corner joint including a vertically extending water flow duct defined by the first snap-mount portion of the back wall and the second snap-mount portion of the end wall wherein the water flow duct is in fluid communication with the first space and the second space.

13. The bathing wall system of claim 12, wherein the first snap-mount portion of the back wall includes a U-shaped channel defined by the terminal end of the back wall, a lateral extension from the back wall, a forward extending snap flange which extends from the lateral extension, and a plurality of protrusions extending from a forwardmost end of the terminal end of the back wall and being spaced apart in a vertical direction along the back wall.

14. The bathing wall system of claim 13, wherein the second snap-mount portion of the end wall includes a plurality of pressure beads spaced apart in a vertical direction, extending laterally out from the end wall and engaging the snap flange of the snap-mount portion of the back wall.

15. The bathing wall system of claim 14, further comprising a connecting web extending between the pressure beads and the second snap-mount portion of the end wall.

16. The bathing wall system of claim 13, wherein the connecting web is spaced apart from the terminal end of the back wall.

17. The bathing wall system of claim 16, wherein the duct is defined by the space between protrusions and the space between the connecting web and the terminal end of the back wall.

18. The bathing wall system of claim 11, wherein the back splash includes a lip which extends inward from top of the back splash.

19. A bathing wall system comprising:

a tub which includes a basin and a shelf bordering and extending out from a top border of the basin;

a back wall supported above the tub and including a first terminal side, an opposing second terminal side, and a first snap-mount portion on each of the first terminal side and the second terminal side;

an end wall supported above the tub, the end wall including an inner side and a second snap-mount portion on the inner side;

wherein the end wall is coupled to the back wall via a snap fit configuration between the second snap-mount portion of the end wall and the first snap-mount portion of the back wall;

a corner joint including a water flow duct defined by the first snap-mount portion of the back wall and the second snap-mount portion of the end wall; and wherein the back wall and the end wall further include a plurality of splines spaced apart along the length of a bottom surface of the back wall and along the length of a bottom surface of the end wall and the plurality of splines engage the shelf of the tub to support the back wall and the end wall and to create a space between the back wall, and the tub, and the end wall and the tub wherein the space between the back wall, the end wall and the tub is in fluid communication with the duct.

20. The bathing wall system of claim 19, wherein the tub further includes a back splash which extends vertically up from and spans the perimeter of the shelf of the tub.

21. The bathing wall system of claim 20, wherein the back wall and the end walls rest upon the tub within the perimeter of the back splash.

22. The bathing wall system of claim 19, wherein the back splash includes a lip which extends inward from top of the back splash.

23. The bathing wall system of claim 22, wherein the tub further includes two raised water dams disposed at forward-most corners of the shelf and defined by a curved shape.

24. The bathing wall system of claim 23, wherein the end wall includes a water dam recess, which nests with one of the raised water dams of the tub.

25. A bathing wall system comprising:

a back wall extending between opposing first and second side edges;

an end wall including a rear edge;

a coupler between the first side edge of the back wall and the rear edge of the end wall, wherein the coupler includes a first coupler portion supported by the back wall, and a second coupler portion supported by the end wall;

wherein the first coupler portion includes a flange and a U-shaped channel defined between the first side edge of the back wall and the flange, and a protrusion spaced forwardly of the U-shaped channel;

wherein the second coupler portion includes a snap groove receiving the protrusion of the first coupler portion, and a positive pressure bead in engagement with the flange of the first coupler portion to exert force on the snap groove against the protrusion; and a U-shaped wall extending transversely within the U-shaped channel, defining a flow restriction and providing a vertical water flow channel.

26. The bathing wall system of claim 25, further comprising a tub including a basin and a shelf bordering and extending out from a top border of the basin, and the back wall and the end wall further includes a plurality of splines spaced apart along the length of a bottom surface of the back wall and along the length of a bottom surface of the end wall, wherein the plurality of splines engage the shelf of the tub to support the back wall and the end wall and to create a space between the back wall, the end wall and the tub.

27. The bathing wall system of claim 26, wherein the tub further includes two raised water dams disposed at forward-most corners of the shelf and defined by a curved shape, and the end wall includes a water dam recess, which nests with the raised water dams of the tub.

* * * * *